US007564574B2

(12) United States Patent
Kikuchi

(10) Patent No.: US 7,564,574 B2
(45) Date of Patent: Jul. 21, 2009

(54) IMAGE FORMING APPARATUS AND FIXING DEVICE THEREFOR

(75) Inventor: Toshiyuki Kikuchi, Chiba (JP)

(73) Assignee: Ricoh Company, Ltd., Ota-ku (JP)

( * ) Notice: Subject to any disclaimer, the term of this patent is extended or adjusted under 35 U.S.C. 154(b) by 1203 days.

(21) Appl. No.: 10/464,575

(22) Filed: Jun. 19, 2003

(65) Prior Publication Data

US 2004/0228644 A1 Nov. 18, 2004

(30) Foreign Application Priority Data

Jun. 21, 2002 (JP) ..... 2002-180808
May 16, 2003 (JP) ..... 2003-138911

(51) Int. Cl.
*G09G 5/00* (2006.01)
*G03G 15/20* (2006.01)

(52) U.S. Cl. ..... 358/1.14; 399/69; 358/1.13

(58) Field of Classification Search ..... 399/69–70, 399/330, 88, 122, 43, 329, 45, 333, 82; 219/216, 219/665, 667, 501; 358/1.13
See application file for complete search history.

(56) References Cited

U.S. PATENT DOCUMENTS 4,172,976 A 10/1979 Namiki et al.
4,284,875 A 8/1981 Namiki et al.
5,024,430 A 6/1991 Seki et al.
5,054,766 A 10/1991 Seki et al.
5,426,495 A 6/1995 Sawamura et al.
5,621,511 A * 4/1997 Nakayama ..... 399/44
5,789,723 A * 8/1998 Hirst ..... 219/501
5,832,354 A 11/1998 Kouno et al.
5,915,147 A 6/1999 Kouno et al.
5,960,233 A * 9/1999 Goto et al. ..... 399/69
5,999,789 A 12/1999 Sawamura
6,085,059 A * 7/2000 Haneda et al. ..... 399/333
6,169,871 B1 1/2001 Higaya
6,198,888 B1 * 3/2001 Kurotaka et al. ..... 399/69
6,255,632 B1 7/2001 Yokoyama et al.

(Continued)

FOREIGN PATENT DOCUMENTS

EP 0 800 121 10/1987

(Continued)

*Primary Examiner*—King Y Poon
*Assistant Examiner*—Allen H Nguyen
(74) *Attorney, Agent, or Firm*—Oblon, Spivak, McClelland, Maier & Neustadt, P.C.

(57) ABSTRACT

An image forming apparatus of the present invention includes a fixing device for fixing a toner image on a sheet with heat. A main and an auxiliary power supply feed power to the fixing device. A switching circuit selectively establishes a usual mode in which the main power supply is connected to the fixing device or an auxiliary mode in which the main and auxiliary power supplies both are connected to the fixing device. A control circuit causes the switching circuit to establish the auxiliary mode in the event of continuous fixation, controls, in the usual mode, the amount of power fed from the main power supply to the fixing device in accordance with the output of a temperature sensor responsive to the temperature of the fixing device, and controls, in the auxiliary mode, the amount of power fed from the main and auxiliary power supplies to the fixing device without regard to the output of the temperature sensor.

10 Claims, 5 Drawing Sheets

U.S. PATENT DOCUMENTS

| | | | | |
|---|---|---|---|---|
| 6,340,810 | B2 | 1/2002 | Yokoyama et al. | |
| 6,359,269 | B1 * | 3/2002 | Hayasaki et al. | 219/665 |
| 6,397,021 | B2 * | 5/2002 | Hayashi et al. | 399/69 |
| 6,542,705 | B2 * | 4/2003 | Fujita et al. | 399/69 |
| 6,768,882 | B2 * | 7/2004 | Omoto et al. | 399/69 |
| 7,058,330 | B2 * | 6/2006 | Nakafuji et al. | 399/69 |
| 2002/0028089 | A1 * | 3/2002 | Yoneda et al. | 399/122 |
| 2002/0108947 | A1 * | 8/2002 | Tsuruya | 219/619 |

FOREIGN PATENT DOCUMENTS

| | | |
|---|---|---|
| JP | 3-5779 | 1/1991 |
| JP | 10-282821 | 10/1998 |
| JP | 2000-98799 | 4/2000 |
| JP | 2000-315567 | 11/2000 |
| JP | 2000315567 | * 11/2000 |
| JP | 2001-66926 | 3/2001 |
| JP | 2002-174988 | 6/2002 |

* cited by examiner

IMAGE FORMING APPARATUS AND FIXING DEVICE THEREFOR

BACKGROUND OF THE INVENTION

1. Field of the Invention

The present invention relates to a copier, printer, facsimile apparatus, a multiplex machine thereof or similar image forming apparatus and more particularly to a fixing device included in an image forming apparatus for fixing a toner image on a recording medium with heat.

2. Description of the Background Art

Generally, an image forming apparatus includes a fixing device configured to fix a toner image formed on a sheet or recording medium with heating means. It is a common practice with the image forming apparatus to feed power to the fixing device from a main or an auxiliary power supply. An image forming apparatus provided with a main and an auxiliary power supply is disclosed in, e.g., Japanese Patent Laid-Open Publication Nos. 2001-66926 (pages 2-4, FIG. 1), 10-282821 (pages 2-3, FIG. 1) and 2002-174988 (pages 2-4, FIG. 1).

However, the problem with the conventional fixing devices is that the drop of fixing temperature to occur during continuous fixation cannot be sufficiently coped with.

Technologies relating to the present invention are also disclosed in, e.g., Japanese Patent Laid-Open Publication No. 2000-315567.

SUMMARY OF THE INVENTION

It is an object of the present invention to provide an image forming apparatus capable of controlling the drop of fixing temperature during continuous fixation and a fixing device for the same.

An image forming apparatus of the present invention includes a fixing device for fixing a toner image on a sheet or recording medium with heat. A main and an auxiliary power supply feed power to the fixing device. A switching circuit selectively establishes a usual mode in which the main power supply is connected to the fixing device for feeding power thereto or an auxiliary mode in which the main and auxiliary power supplies both are connected to the fixing device for feeding power thereto. A control circuit controls the switching circuit and includes a temperature sensor responsive to the temperature of the fixing device. The control circuit causes the switching circuit to establish the auxiliary mode in the event of continuous fixation, controls, in the usual mode, the amount of power being fed from the main power supply to the fixing device in accordance with the output of the temperature sensor, and controls, in the auxiliary mode, the amount of power being fed from the main and auxiliary power supplies to the fixing device without regard to the output of the temperature sensor.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
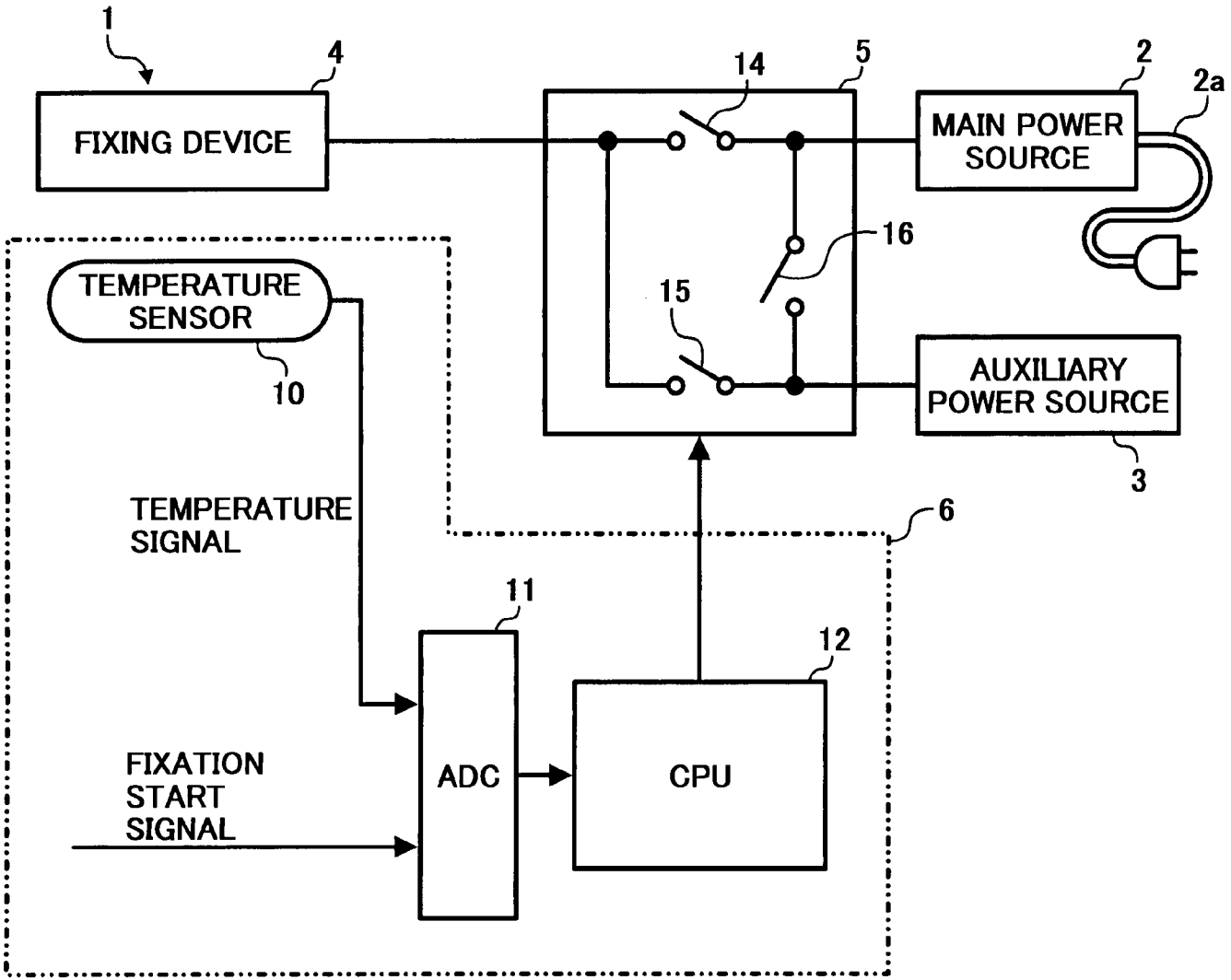
FIG. 1 is a schematic block diagram showing an image forming apparatus embodying the present invention.

Referring to FIG. 1 of the drawings, an image forming apparatus embodying the present invention is shown and generally designated by the reference numeral 1. As shown, the image forming apparatus 1 includes a fixing device 4 for fixing a toner image on a sheet or recording medium. A main power supply 2 is connected to a commercial power supply and feeds particular power to each of various sections included in the apparatus 1. An auxiliary power supply 3 is capable of feeding power independently of the main power supply 2. A switching circuit 5 intervenes between the main power supply 2, auxiliary power supplies 3 and fixing device 4 in order to selectively establish electrical connection therebetween. A control circuit 6 controls the switching device 5.

The main power supply 2 is connected, via a cord 2*a*, to an outlet available at a place where the apparatus 1 is situated, receiving a general AC current from a commercial power supply. The main power supply 2 is capable of converting the AC current to a DC current and rectifying it and outputting a voltage matching with the heating characteristic of the fixing device 4 or the charging characteristic of the auxiliary power supply 3.

The auxiliary power supply, implemented as a secondary power supply, is capable of feeding power alone without regard to the main power supply 2 or the outside power supply. The auxiliary power supply 3 includes charging means implemented as a capacitor having rapid charge/discharge capability. For the capacitor, use is made of an electric double layer capacitor having a capacity of about 2,000 F (farads). Therefore, when the auxiliary power supply 3 is electrically connected to the fixing device 4 together with the main power supply 2, the auxiliary power supply 3 can feed sufficient power to the fixing device 4 for about several ten seconds.

The electric double layer capacitor uses an electric double layer appearing at an interface where a polarizing electrode formed of active carbon and an electrolyte implemented by an organic solvent contact each other. This kind of capacitor can be rapidly charged and discharged and remains stable despite repeated charging and discharging, as known in the art. The auxiliary power supply 3 is provided with a protection circuit, not shown, for preventing a charge current exceeding the breakdown voltage of the capacitor from flowing through the capacitor, thereby obviating overcharging.

Figure 2:
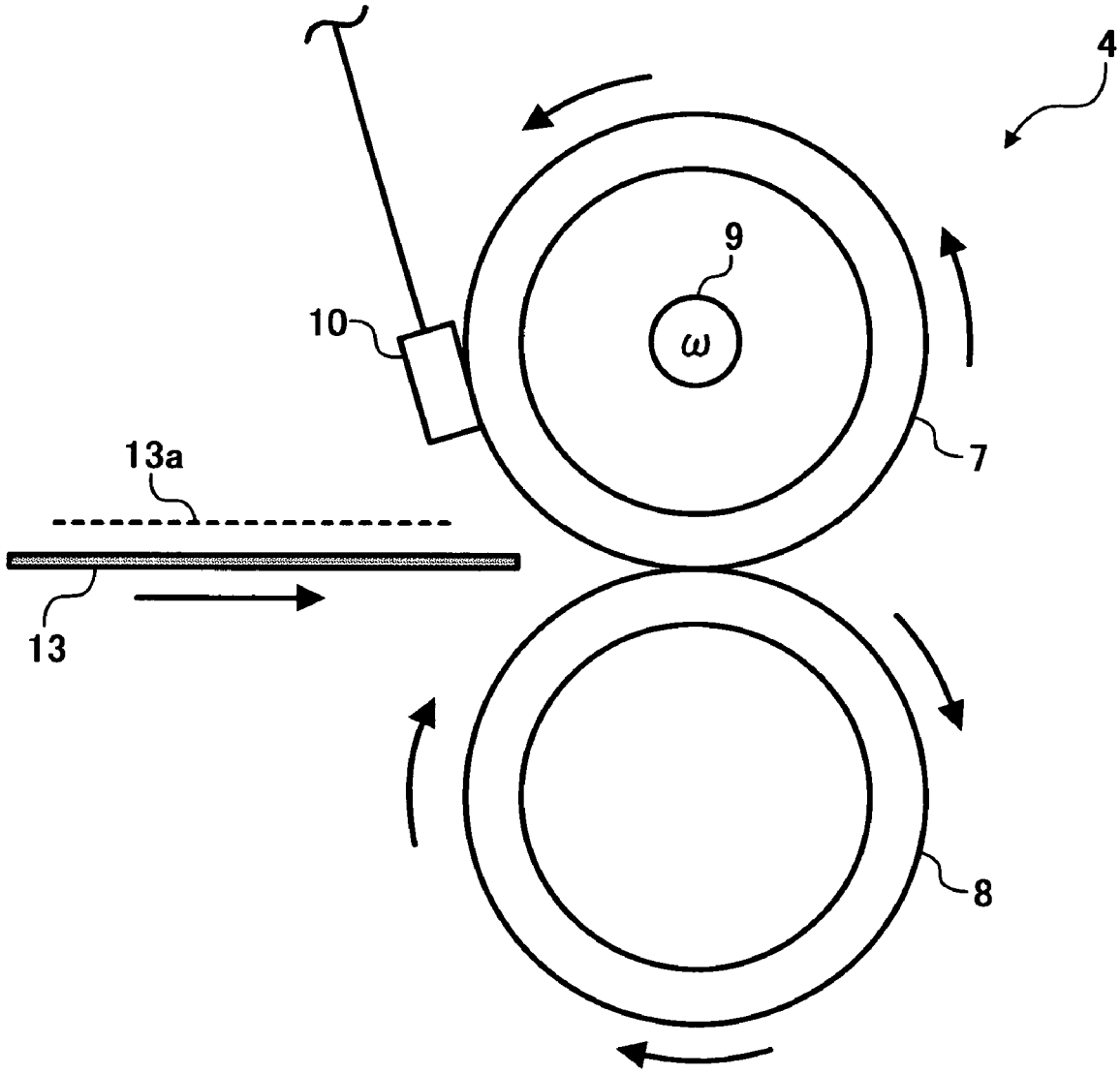
FIG. 2 is a section showing a fixing device included in the illustrative embodiment.

FIG. 2 shows a specific configuration of the fixing device 4. As shown, the fixing device 4 includes a heat roller 7 accommodating a heater 9 therein and a press roller 8 pressed against the heat roller 7. The heater 9, constituting heating means for heating the heat roller 7 to preselected fixing temperature, receives power from one or both of the main and auxiliary power supplies 2 and 3 via the switching circuit 5. The heater 9 is capable of increasing or decreasing the amount of heat in accordance with the input power. This is true even when power is fed to the heater 9 from both of the main and auxiliary power supplies 2 and 3.

A temperature sensor 10 adjoins the outer periphery of the heat roller 7 and senses the temperature or fixing temperature of part of the outer periphery of the heat roller 7 that is about to contact a sheet 13 carrying a toner image 13*a* thereon. As shown in FIG. 1, the output of the temperature sensor 10 is sent to a CPU (Central Processing Unit) 12 via an ADC (Analog-to-Digital Converter) 11. The sheet 13 is conveyed to the nip between the heat roller 7 and the press roller 8 by a conveying mechanism not shown.

As shown in FIG. 1, the switching circuit 5 includes three switches 14, 15 and 16. The switch 14 is positioned on a path connecting the fixing device 4 and main power supply. The switch 14 is positioned on a path joining the above path and connecting the fixing device 4 and auxiliary power supply 3. The switch 16 is positioned on a path connecting the main and auxiliary power supplies 2 and 3. In this configuration, by suitably controlling the switches 14 through 16, it is possible to establish any one of a usual mode for feeding power from the main power supply 2 to the fixing device 4, an auxiliary mode for feeding power from both of the main and auxiliary power supplies 2 and 3 to the fixing device 4, and a charge mode for feeding power from the main power supply 2 to the auxiliary power supply 3. This control over the switching circuit 5 is executed by the control circuit 6 whose major component is the CPU 12.

The control circuit 6 is made up of the temperature sensor 10 responsive to the temperature of the heat roller 7, ADC 11 to which the output of the temperature sensor 10 and a fixation start signal generated in relation to the operation of a print start switch are input, and CPU 12 to which digital signals are input from the ADC 11. The CPU 12 selectively turns on or turns off each of the switches 14 through 15 of the switching circuit 5. More specifically, the ADC 11 digitizes the output of the temperature sensor 10 representative of the instantaneous temperature T of the heat roller 7 and the fixation start signal and delivers the resulting digital values to the CPU 12. The CPU 12 executes, in accordance with the digital values, processing based on a program stored beforehand, thereby controlling power feed via the switching device 5.

In operation, assume that the temperature of the heat roller 7 sensed by the temperature sensor 10 is lower than stand-by temperature TH (see FIGS. 3 through 5) at the time of, e.g., power-up of the apparatus 1. Then, the CPU 12 determines that the heat roller 7 must be heated, and turns on the switch 14 of the switching device 5 to thereby connect the main power supply 2 to the fixing device 4. At the same time, the CPU 12 turns off the switches 15 and 16 for thereby disconnecting the auxiliary power supply 3 from the electric circuitry. Consequently, the entire power output from the main power supply 2 is fed to the fixing device 4, so that the heat roller 7 is rapidly heated to the stand-by temperature TH that allows the heat roller 7 to perform fixation.

When the heat roller 7 is heated above the stand-by temperature TH, as sensed by the temperature sensor 10, the CPU 12 turns off the switch 14 in response to the output of the temperature sensor 10, disconnecting the main power supply from the fixing device 4. Subsequently, the CPU 12 checks the amount of charge stored in the capacitor of the auxiliary power supply 3 that has the previously stated function. If the amount of charge stored is short, then the CPU 12 turns on the switch 16 to connected the main power supply 2 to the auxiliary power supply 3. As a result, power is fed from the main power supply 2 to the auxiliary power supply 3 to thereby charge the capacitor. As soon as the capacitor is fully charged, the CPU 12 turns off the switch 16. The fixing device 4 is now ready to perform fixation. On the other hand, if the capacitor of the auxiliary power supply 3 is fully charged, as determined by the CPU 12 after the turn-off of the switch 14, the switch 16 is continuously turned off, so that the fixing device 4 becomes ready to operate immediately.

In the usual mode, the control circuit 6 controls, based on the output of the temperature sensor 10, the amount of power being fed from the main power supply 2 to the heater or heating means 9. In a stand-by or inoperable condition, the control circuit 6 turns on and turns off only the switch 14 in a preselected manner so as to control the amount of power being fed to the heater 9, thereby maintaining the temperature of the heat roller 7 around the stand-by temperature TH. More specifically, when the sensed temperature is higher than the stand-by temperature by a preselected value, the control circuit 6 turns off the switch 14 to thereby stop heating the heater 9. When the sensed temperature is lower than the stand-by temperature TH by a preselected value, the control circuit 6 turns on the switch 14 to thereby start heating the heater 9. Such control confines the temperature of the heat roller 7 within a preselected range around the stand-by temperature TH.

In the illustrative embodiment, power feed from the auxiliary power supply 3 begins at the same time as the start of power feed from the main power supply 2 not at the time when the temperature of the heat roller 7 is noticeably lowered due to continuous fixation, i.e., when power for heating the heat roller 7 is determined to be short, but at the time when the noticeable drop of the temperature is estimated. More specifically, in response to the fixation start signal generated by the apparatus 1 and indicative of continuous fixation, the fixing device 4 starts continuous fixation. At this instant, the control circuit 6 conditions the switching circuit 5 for the auxiliary mode instead of for the usual mode. In the auxiliary mode, the switches 14 and 15 of the switching circuit 5 both are turned on. Consequently, power is fed from both of the main and auxiliary power supplies 2 and 3 to the fixing device 4, i.e., more power is fed to the fixing device 4 than when only the main power supply 2 is connected to the fixing device 4. This successfully reduces the temperature drop of the heat roller 7 ascribable to continuous fixation.

On the other hand, in the auxiliary mode, the control circuit 6 controls the amount of power being fed from the main and auxiliary power supplies 2 and 3 to the heater 9 without regard to the output of the temperature sensor 10. More specifically, the ON/OFF control over the switch 14 for maintaining the heat roller 7 at preselected temperature is not executed, i.e., the switches 14 and 15 are continuously turned on. This obviates an occurrence that power feed from both of the main and power supplies 2 and 3 is not executed until the temperature of the heat roller 7 actually drops, i.e., until temperature lower than the stand-by temperature TH by the preselected value has been sensed.

In the auxiliary mode, therefore, the heater 9 can exhibit its maximum heating ability. Further, power feed from the main and auxiliary power supplies 2 and 3 is not effected after the temperature drop of the heater 7 has been sensed, so that such power feed can be effected at earlier timing. It follows that a time lag between the start of power feed and the actual temperature elevation of the heater 7 is reduced by the advance of the above power feed timing, reducing the probability of defective fixation ascribable to the short temperature of the heat roller 7. On the other hand, in the auxiliary mode, the control circuit 6 controls the amount of power being fed from the main and auxiliary power supplies 2 and 3 to the heater 9 without regard to the output of the temperature sensor 10, as stated earlier. It is, therefore, likely that the temperature of the fixing device 4 rises to an overheat level for a moment. However, the overheat level can be immediately canceled because sheets 13 are continuously conveyed via the fixing device 4 throughout continuous fixation.

Figure 3:
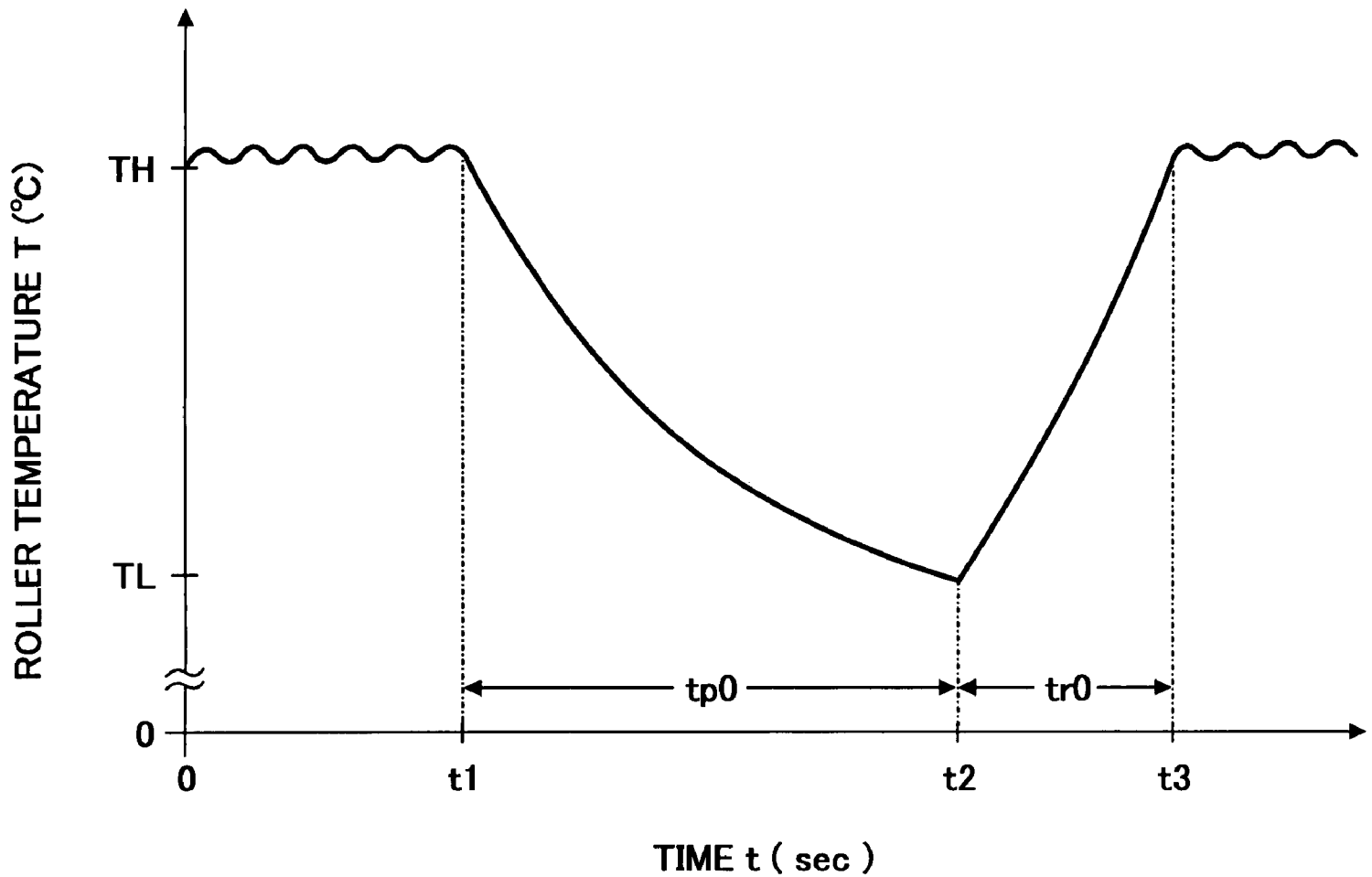
FIG. 3 is a graph shows the variation of the temperature of a heat roller included in an image forming apparatus lacking an auxiliary power supply.

In a conventional image forming apparatus lacking the configuration of the illustrative embodiment whose major component is the auxiliary power supply 3, the temperature of a heat roller continuously drops throughout continuous fixation. As a result, as shown in FIG. 3, the heat roller temperature drops from the highest temperature (stand-by temperature TH) implementing adequate fixation below the lowest temperature (lower limit TL). More specifically, consecutive sheets continuously conveyed via the heat roller take heat from the heat roller, so that heating of the heat roller becomes short. To cope with defective fixation ascribable to such short heating, it is necessary to interrupt the mechanical operation of the apparatus, restore the adequate temperature of the heat roller, and then resume the mechanical operation.

In FIG. 3, the ordinate and abscissa indicate heat roller temperature T and time t, respectively. As shown, continuous fixation starts at a time t1 while the heat roller temperature T drops to the lower limit TL at a time t2. Continuous fixation is allowed to continue from the time t1 to the time t2, i.e., over a period of time of tp0. A period of time of tr0 is necessary for the heat roller temperature T to restore the adequate temperature from the time t2 to a time t3.

To reduce or obviate the recovery time tr0 mentioned above, power to be fed to a heater maybe increased to reduce or obstruct the temperature drop of the heat roller ascribable to continuous fixation. This scheme, however, increases the maximum power consumption of the entire apparatus and therefore needs an electric installation capable of feeding more power, making a common, commercial power supply unusable.

Figure 4:
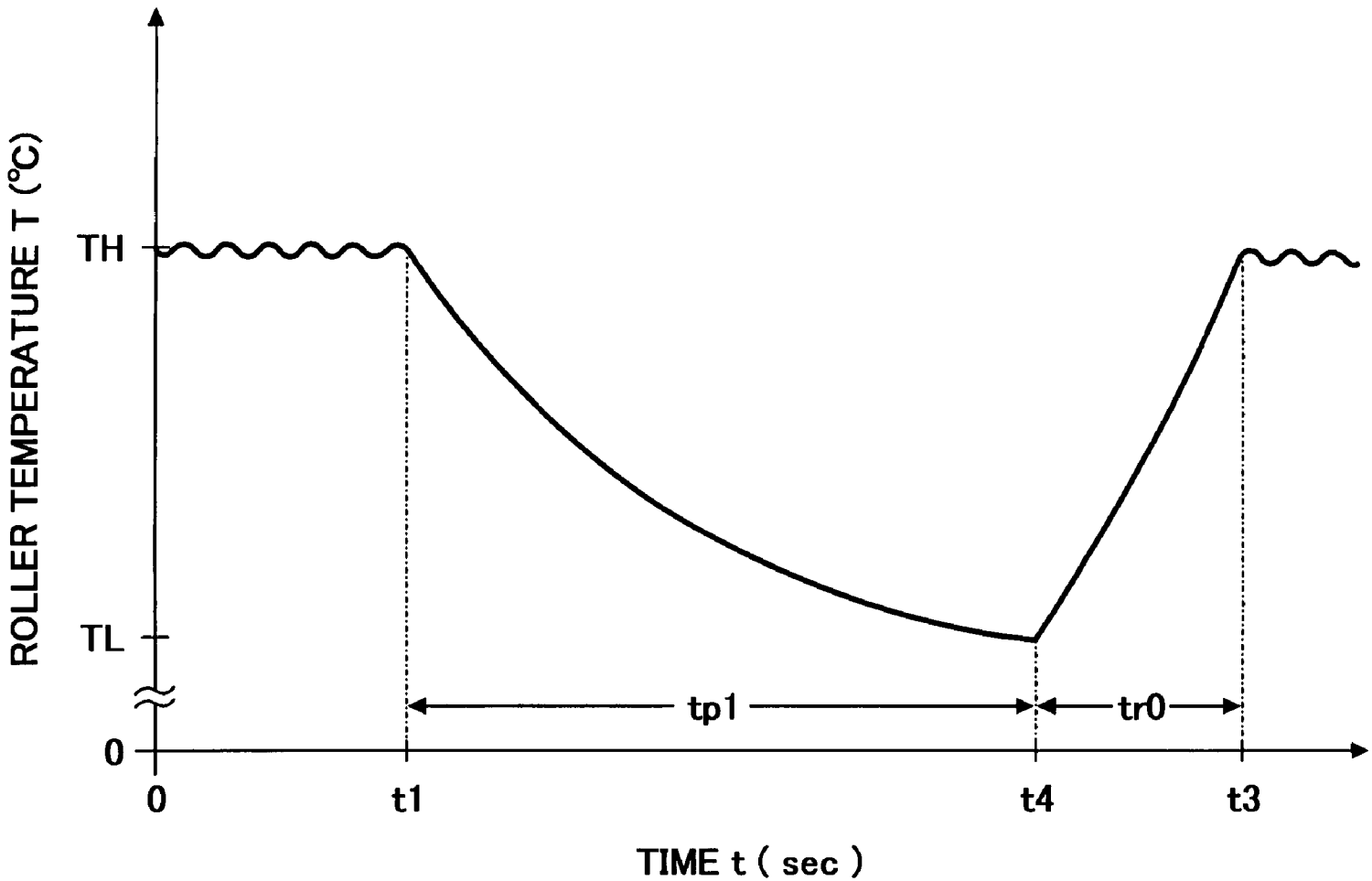
FIG. 4 is a graph showing the variation of the temperature of a heat roller included in the illustrative embodiment.

FIG. 4 shows the temperature variation of the heat roller 7 of the illustrative embodiment occurring during continuous fixation. As shown, the heat roller temperature T starts dropping from the stand-by temperature TH toward the lower limit TL from the time t1 at which fixation begins, because consecutive sheets take heat from the heat roller 7. At this instant, in the illustrative embodiment, power is fed from the auxiliary power supply 3 to the fixing device 4 in addition to the power of the main power supply 2, reducing the rate of temperature drop, compared to the variation of FIG. 3. Consequently, a period of time tp1 between times t1 and t4 over which the heat roller temperature T drops from TH to TL is noticeably extended. Therefore, the period of time tp1 over which continuous fixation can be effected without lowering fixing speed can be increased. It follows that the number of sheets that can be dealt with over the period of time tp1 is increased, enhancing the continuous fixing ability of the apparatus 1.

After the last sheet 13 has been driven out of the fixing device 4, the switch 15 is turned off to interrupt power feed from the auxiliary power supply 3 to the fixing device 4. This is followed by processing for restoring the heat roller temperature to the stand-by temperature TH with the power of the main power supply 2 and processing for charging the auxiliary power supply 3.

Because the maximum number of sheets that can be dealt with during continuous fixation is increased, as stated above, the mechanical operation of the apparatus 1 is free from frequent interruption and therefore appears natural and reliable to the operator.

In the illustrative embodiment, the chargeable, auxiliary power supply 3 independent of the main power supply 2 guarantees additional power necessary for controlling the temperature drop of the heat roller 7 during continuous fixation. This prevents the maximum power consumption of the apparatus 1 from increasing and therefore allows a common, commercial power supply to be used. More specifically, the auxiliary power supply 3 independent of the outside power supply can feed power to the fixing device 4 without increasing the voltage and other loads of the outside power supply, so that the apparatus 1 can be situated at any desired place so long as an outlet is available. In addition, the other apparatuses sharing the same commercial power supply with the fixing device 4 are free from electrical influence of the fixing device 4.

Further, when a period of time necessary for continuous fixation is shorter than the period of time tp1, the illustrative embodiment can reduce a period of time over which the mechanical operation should be interrupted. For example, assume that the apparatus 1 is operated under the same conditions as a conventional image forming apparatus capable of continuously fixing a given maximum number of images without any interruption. Then, the conventional apparatus causes the heat roller temperature to vary as indicated by a dashed curve in FIG. 5.

Figure 5:
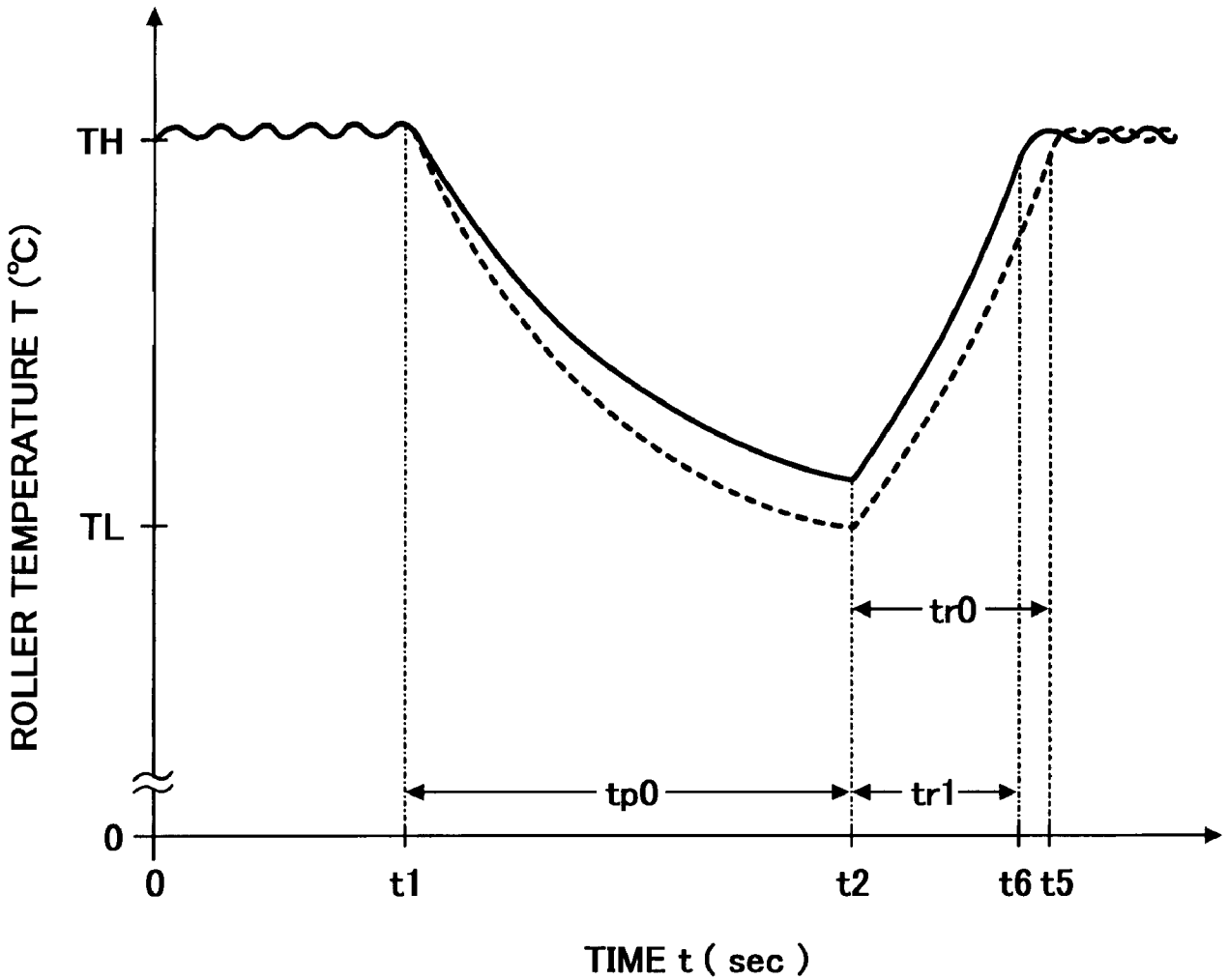
FIG. 5 is a graph comparing the heat roller of the conventional apparatus lacking an auxiliary power supply and the heat roller of the illustrative embodiment as to temperature variation.

By contrast, in the illustrative embodiment, additional power fed from the auxiliary power supply 3 prevents the heat roller temperature from dropping to the lower limit TL, as indicated by a solid curve in FIG. 5. Therefore, the heat roller temperature T is higher than the lower limit TL without fail at a time t2 at which the last sheet is driven out of the developing device 4. As a result, the difference between the heat roller temperature at the time t2 and the stand-by temperature TH decreases, so that a time t6 at which the heat roller temperature T returns to the stand-by temperature is advanced. This makes the recovery time tr1 shorter than the conventional recovery time tr0 and therefore reduces the period of time over which the mechanical operation should be interrupted. It follows that when the period of time necessary for continuous fixation is shorter than the period of time tp1, the apparatus 1 can immediately start the next processing and has its performance enhanced.

The electric double layer capacitor, implementing the auxiliary power supply 3, is free from limitations particular to a secondary battery of the type storing electric energy on the basis of electrochemical reaction. More specifically, several hours are necessary for a general nickel-cadmium battery to be charged even in the case of rapid charging. By contrast, an electric double layer capacitor can be rapidly charged in about several seconds. Therefore, the auxiliary power supply 3 is prevented from missing the chance of controlling the temperature drop of the fixing device 4. This allows the auxiliary power supply 3 to surely feed additional power every time continuous fixation is executed.

Further, the upper limit of repeated charging and discharging available with a nickel-cadmium battery is 500 times to 1,000 times while the upper limit available with a electric double-layer capacity is 100,000 times or more. This extends the life of the auxiliary power supply 3 as a single unit and thereby reduces time and labor for the replacement of the auxiliary power supply 3, reduces supply cost, and enhances easy handling.

Moreover, even a miniature, electric double layer capacitor can implement a capacity of the order of farads because an active carbon electrode and an electrolyte thereof contact over a broad area and because the distance between dielectrics is extremely short. Such a capacitor therefore makes the auxiliary power supply 3 small size and lightweight. This kind of capacitor is desirable from the environment standpoint as well because the major components are active carbon and an organic solvent.

The illustrative embodiment may be modified such that the auxiliary power supply 3 feeds additional power to the fixing device 7 only when various conditions that can be recognized by the apparatus 1 in the event of image formation indicate that the temperature of the heat roller 7 will drop to the lower limit TL due to continuous fixation. For example, when the apparatus 1 is implemented as a copier, the apparatus may determine whether or not the heat roller temperature will drop to the lower limit TL during continuous exposure on the basis of, e.g., whether or not the apparatus 1 is operated for the first time and various conditions including the number of desired copies, the image size determined by magnification, the size and thickness of sheets to be used, the number of sheets to be dealt with for a unit time, and the simplex/duplex copy mode. Further, when the apparatus 1 is implemented as a printer or a facsimile apparatus, the apparatus may select the above conditions on the basis of the amount or the contents of data received from the outside of the apparatus 1.

Stated another way, when the temperature of the heat roller 7 is not expected to drop to the lower limit TL during continuous exposure, the discharge of the auxiliary power supply 3 can be controlled to the minimum necessary number of times. This not only extends the life of the auxiliary power supply 3 that must not be charged and discharged more than a preselected number of times, but also saves power of the entire apparatus 1.

Further, when any power is left in the auxiliary power supply 3 at the end of continuous fixation, the residual power may be used to restore the heat roller to the same stand-by temperature TH as before continuous fixation. More specifically, an arrangement may be made such that the residual power available with the auxiliary power supply 3 may be checked at the time t2, FIG. 5, or estimated from the duration of continuous fixation, in which case, if the residual power is available, then the connection of the main and auxiliary power supplies 2 and 3 to the fixing device 4 will be maintained.

By using the residual power of the auxiliary power supply 3, as stated above, it is possible to further reduce the recovery time of the heat roller temperature T to the stand-by temperature TH for thereby preparing the apparatus 1 for the next fixation in a short period of time. Further, because power left in the auxiliary power supply 3 after the feed of additional power, the chance that the auxiliary power supply 3 can be fully charged and fully discharged is increased, making the most of the ability of the auxiliary power supply 3 limited in the number of times of charging and discharging.

In summary, it will be seen that the present invention provides an image forming apparatus capable of increasing, during continuous fixation, the heating ability of a fixing device with additional power available with an auxiliary power supply, thereby controlling the drop of fixing temperature.

Various modifications will become possible for those skilled in the art after receiving the teachings of the present disclosure without departing from the scope thereof.

What is claimed is:

1. An image forming apparatus comprising:

a fixing device configured to fix a toner image on a recording medium with a heater which generates heat when applied with power;

a main and an auxiliary power supply configured to feed power to said fixing device;

a switching circuit configured to selectively establish a usual mode in which said main power supply is connected to said fixing device for feeding power to said fixing device or an auxiliary mode in which said main power supply and said auxiliary power supply both are connected to said fixing device for feeding power to said fixing device; and a control circuit configured to control said switching circuit and including a temperature sensor responsive to a temperature of said fixing device;

wherein said control circuit causes said switching circuit to establish said auxiliary mode in the event of continuous fixation, controls, in said usual mode, an amount of power being fed from said main power supply to said heater in accordance with an output of said temperature sensor, and controls, in said auxiliary mode during continuous fixation, an amount of power being fed from said main power supply and said auxiliary power supply to said heater without regard to the output of said temperature sensor.

2. The apparatus as claimed in claim 1, wherein said auxiliary power supply is charged when fixation is not under way.

3. The apparatus as claimed in claim 1, wherein said auxiliary power supply comprises a capacitor which provides auxiliary power.

4. The apparatus as claimed in claim 3, wherein said auxiliary power supply is charged when fixation is not under way.

5. The apparatus as claimed in claim 1, wherein said auxiliary power supply comprises a secondary power supply to be charged by said main power supply.

6. The apparatus as claimed in claim 5, wherein said auxiliary power supply comprises a capacitor which provides auxiliary power.

7. The apparatus as claimed in claim 6, wherein said auxiliary power supply is charged when fixation is not under way.

8. An image forming apparatus according to claim 1, wherein:

the control circuit causes said switching circuit to use the usual mode in which power is fed to the fixing device using only the main power supply, during a period of starting to heat the heater of the fixing device.

9. An image forming apparatus according to claim 1, wherein:

the heater of the fixing device is a single heater.

10. An image forming apparatus comprising:

fixing means for fixing a toner image on a recording medium with heating means for generating heat when applied with power;

a main and an auxiliary power supply configured to feed power to said fixing means;

switching means for selectively establishing a usual mode in which said main power supply is connected to said fixing means for feeding power to said fixing means or an auxiliary mode in which said main power supply and said auxiliary power supply both are connected to said fixing means for feeding power to said fixing means; and control means for controlling said switching means and including temperature sensing means for sensing a temperature of said fixing means;

wherein said control means causes said switching means to establish said auxiliary mode in the event of continuous fixation, controls, in said usual mode, an amount of power being fed from said main power supply to said heating means in accordance with an output of said temperature sensing means, and controls, in said auxiliary mode during continuous fixation, an amount of power being fed from said main power supply and said auxiliary power supply to said heating means without regard to the output of said temperature sensing means.

* * * * *